US005180057A

United States Patent [19]

Franklin

[11] Patent Number: 5,180,057

[45] Date of Patent: Jan. 19, 1993

[54] EXPANDABLE GARMENT BAG AND HANGER BAR THEREFOR

[75] Inventor: Dana Franklin, Denver, Colo.

[73] Assignee: Samsonite Corporation, Denver, Colo.

[21] Appl. No.: 670,121

[22] Filed: Mar. 15, 1991

[51] Int. Cl.[5] ..... A47F 7/24; A45C 7/00; A45C 11/00; B65D 85/18

[52] U.S. Cl. ..... 206/279; 206/287; 190/14; 190/103; 211/89

[58] Field of Search ..... 190/13 R, 13 C, 14, 190/103, 111; 206/287, 287.1, 289-292, 279; 211/89, 124, 105.3, 123; 248/316.1

[56] References Cited

U.S. PATENT DOCUMENTS

| | | | |
|---|---|---|---|
| 971,647 | 10/1910 | Vanderveld | 211/105.3 X |
| 2,072,685 | 3/1937 | Richter | 206/289 X |
| 2,357,309 | 9/1944 | Brown et al. | 206/290 X |
| 2,681,128 | 6/1954 | Staffa | 190/13 R |
| 3,542,170 | 11/1970 | Bialo | 206/287.1 X |
| 4,736,854 | 4/1988 | King et al. | 211/89 |
| 4,778,089 | 10/1988 | White et al. | 211/105.3 X |
| 4,782,947 | 11/1988 | Sheiman | 190/13 R X |
| 4,819,796 | 4/1989 | Gerch et al. | 190/111 X |
| 4,852,845 | 8/1989 | Lener | 206/291 X |
| 4,905,826 | 3/1990 | Martin | 206/289 X |

FOREIGN PATENT DOCUMENTS

| | | | |
|---|---|---|---|
| 636426 | 2/1962 | Canada | 211/105.3 |
| 14970 | 9/1980 | European Pat. Off. | 211/105.3 |
| 1451442 | 9/1966 | France | 190/119 |
| 153172 | 11/1920 | United Kingdom | 190/13 R |
| 179710 | 5/1922 | United Kingdom | 190/13 |
| 2044094 | 10/1980 | United Kingdom | 211/124 |

*Primary Examiner*—Sue A. Weaver
*Attorney, Agent, or Firm*—Gregory W. O'Connor

[57] ABSTRACT

Past garment bags have included expansion features such as a peripheral zipper in the rail portion to permit the garment bag to expand to accommodate a greater number of clothes. A hanger bar for supporting clothes on hangers has also been provided which has a collapsed condition for supporting few hangers, and an expanded condition for supporting a greater number of hangers corresponding to the expanded condition of the garment bag in which the hanger bar is suspended. Such hanger bars have failed to include an effective means for holding the hooked portions of ordinary closet-type hangers in either the collapsed or expanded condition of the hanger bar. Disclosed is such a garment bag with a hanger bar having hanger retaining means which is effective whether the hanger bar has a shortened length corresponding to the collapsed condition of the garment bag or a lengthened condition corresponding to an expanded condition of the garment bag. In particular, an L-shaped retainer is carried by a first telescoping section of the hanger bar and operates simultaneously to keep hangers from falling off the front end of the hanger bar and from being dislodged upwardly away from the hanger bar.

14 Claims, 3 Drawing Sheets

EXPANDABLE GARMENT BAG AND HANGER BAR THEREFOR

BACKGROUND OF THE INVENTION

The invention relates to garment bags, and in particular, garment bags which can be altered on demand to provide greater depth to accommodate a larger number of garments on hangers than would otherwise be possible. More particularly, the invention relates to hanger bar and retainer system for the garments on hangers normally suspended within the garment bag's main packing section.

Garment bags have included a zipper track mechanism positioned in the rail or gusset portion of the garment bag which permits the garment bag to have two thicknesses or depths. This zipper arrangement is detailed in U.S. Pat. No. 3,443,367, herein incorporated by reference. In general, this zipper arrangement comprises a zipper track which extends beyond a full periphery of the rail portions of the garment bag to close upon itself. Between the separate zipper tracks is a fabric panel or gusset which can be folded up on action of the zipper, closing the zipper track. In this way, the rails of the garment bag can be expanded to accommodate the extra depth defined by this fabric section. A simple bar-like device for retaining hangers has been provided in these types of garment bags. The hanger bar includes one, and perhaps two, rectangular shaped loops of steel bar, the bar having a diameter of about 0.25". The loop is provided with a hinge, approximately in its middle, to permit the outer ends of the bar loop to pivot at right angles to the vertical plane. The non-pivoted portion of the bar is fixed to the upper rail of the garment bag. When the garment bag is in its collapsed state or, in other words, when the zipper is closed to fold up the cloth section, the hanger bar is normally folded to present a fairly short bar portion to accommodate hangers. When the zipper track arrangement is operated to expand the cloth section. The user may pivot the outer end of the bar loop outward to present an elongated bar section for hanging a greater number of garments on hangers. This pivotal hanger bar arrangement is sized to accommodate primarily the pivoting-hook type hangers, sometimes called "Gooseneck" type hangers, rather than the hooked portions of ordinary closet-type hangers. If the user places a hooked portion of the hanger over such a hanger bar, there is no effective means for retaining the hooked portion in place over the hanger bar. Thus, it is likely that the hooked portion will become disengaged from the bar and the garments thereon will fall to the bottom of the garment bag causing undue wrinkling of those garments.

U.S. Pat. No. 4,736,854, assigned to the assignee of the present invention, shows a telescoping hanger bar which includes a spool-like member which can be extended to a situation wherein the hooked portions of hangers can be placed over the hanger bar. When locked in the collapsed position, the hangers are retained beneath a concave surface on the inside of the hanger bar construction. When the telescoping hanger bar is in its extended position, there is no mechanism for retaining the hooked portion of the hangers, nor is there means provided for locking the spool-like portion of the hanger bar in this extended position. Thus, while the telescoping operation has great benefit when packing, it is relatively unusable for accommodating the greater packing capacity of garment bags of the type described above.

OBJECTS OF THE INVENTION

Accordingly, it is an object of the present invention to provide a garment bag having variable packing capacity of the type described above and provided with a hanger bar which receives the hooked portion of ordinary closet-type hangers and retains those hooked portions thereon even when the device is expanded to accommodate a greater number of garments on hangers corresponding to the increased packing capacity of the expanded garment bag.

Another object of the invention is to provide a hanging device for hooked-type hangers which has two lengths, a first length accommodating at least one of such garments, and a second length accommodating a greater number of garments on hangers. In both lengths, there is provided a retaining surface positioned above the hanger bar for retaining the hooked portions in place.

SUMMARY OF THE INVENTION

Accordingly, provided is a luggage case of the type used to hold garments on hangers. A luggage case includes a device for suspending such hangers by engaging the hooked portions thereof. This device includes a bar means over which hooked portions of hangers may be positioned. The bar means defines a first length from which at least one of the garments on hangers may be hung. A means is positioned above and at the end of the bar to retain the hooked portions on the bar means. Also provided is means for lengthening the bar means beyond that first length to a second length where a greater number of garments on hangers may be accommodated. Also provided is a device for locking the bar means in either its first length or its second length.

The luggage case preferably has a slide type fastener and track arrangement to permit the luggage case to be selectively expanded in volume to accommodate varying numbers of garments on hangers. The means for retaining the hooked portion of hangers comprises an L-shaped member, one end of which is attached to the distal end of the bar and the other end extends parallel to and above the bar. This L-shaped member is positioned above the bar both when it is in its first length as well as when it is in its second length. The invention also comprises a device for suspending garments on hangers within a garment bag comprising means for fastening the device to the upper portion of the garment bag, and a bar over which hooked portions of the hangers may be positioned. There is a device provided for lengthening the bar beyond the first length to a second length whereby a greater number of garments may be accommodated thereon. Also provided is means for locking the bar in either its first length or its second length.

This means for locking preferably comprises a cam in the form of a slot on a cam follower which is carried in the slot.

The bar comprises a first telescoping section fixed to the device, and the second telescoping section actually mounted to the first section for axial movement relative to the first telescoping section. Preferably, the cam and the cam-follower are carried respectively by the first section and the second section.

The suspending device includes means for retaining the hooked portions of the hangers on the bar. This means comprises an L-shaped member, one end of which is fastened to the second telescoping portion, and the other end extends back over the bar. In this manner, the L-shaped retaining member is carried by the second telescoping section, and thus operates to retain hooked portions of the garments regardless of whether the bar is in its first length or has been extended to its second length.

DETAILED DESCRIPTION OF THE INVENTION

Figure 1:
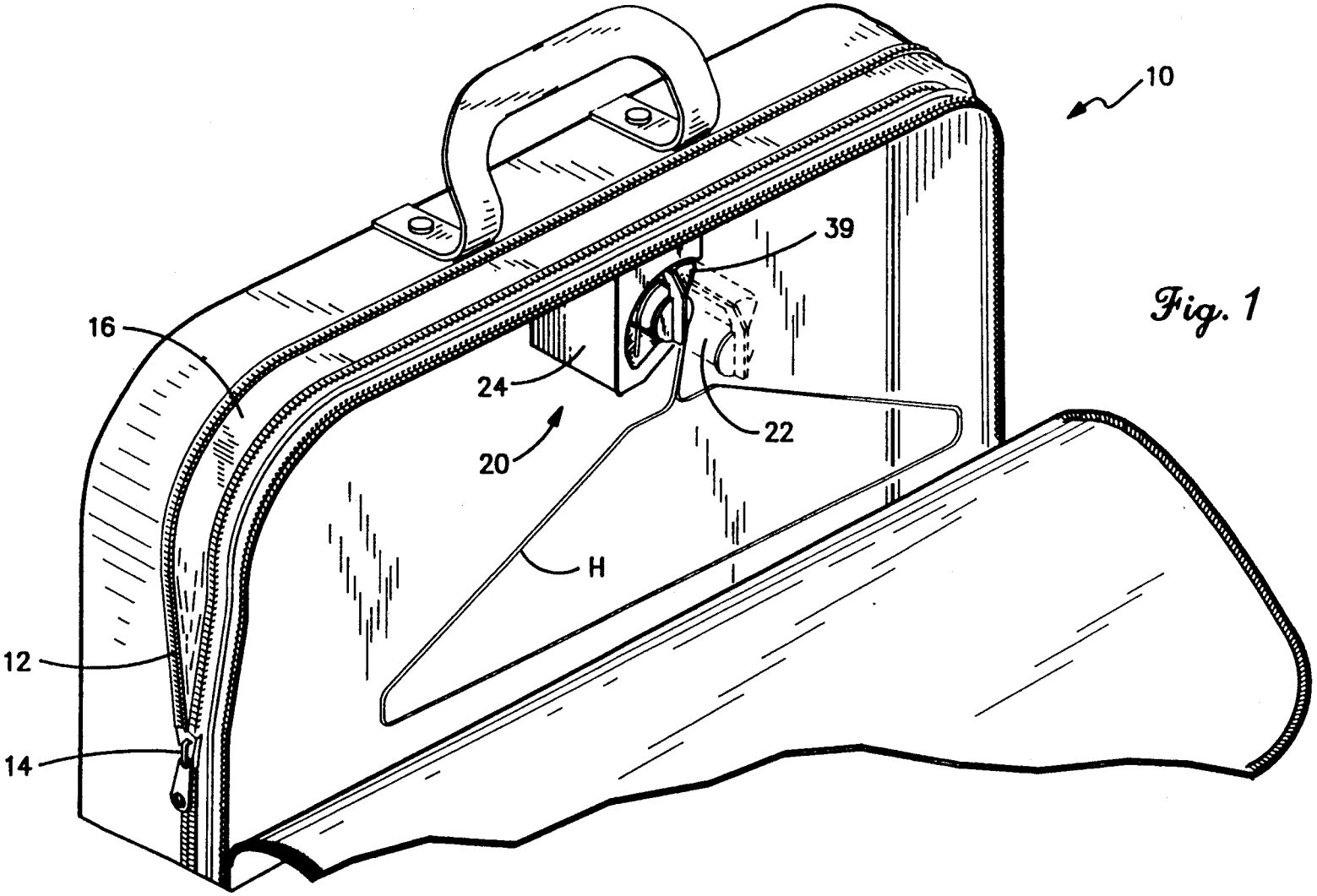
FIG. 1 shows a luggage case of a garment bag type in accordance with the instant invention.

The garment bag (10) is of a generally known type and includes a zipper track and zipper slider and track arrangement (12) which extends around the entire periphery of the garment bag in the rail or gusset portion thereof. The slider (14) is mounted on the track arrangement to permit a cloth section (16), also extending around the full periphery of the garment bag, to either be folded up beneath the closed zipper track, or extended to in turn actually increase the width of the rail portion of the garment bag. In this way, varying amounts of garments can be packed in the garment bag. It is known that garments are retained in a relatively wrinkle-free condition if they are packed firmly, but not crushed, within a garment bag or other luggage case. Accordingly, with the help of the operation of the zipper slider (14) as outlined above, garments can be packed more easily for safe travel.

Within the garment bag is a hanger suspending device (20). Hanger H is shown to illustrate the operation of the device. The device (20) includes rod means (22), which is held in cantilever fashion by body portion (24). Body portion (24) itself provides means (**24*a*) for suspending the device (20) from the upper portion of the garment bag (10). The bar means (22) as detailed below, is provided with means which lengthens the bar means from the first length, as shown in solid lines in FIG. 1 (to accommodate at least one garment hanger), to a second length, as shown in phantom in FIG. 1. In this second length condition, a greater number of garments on hangers can be accommodated. A hanger retaining means (30) is positioned so as to resist the dislodging of the hooked portion of the hangers from the hanger bar means. As will be detailed below, the retaining means (30) includes a concave surface (33 of FIG. 4**) positioned parallel to and above the hanger bar in a manner generally taught by U.S. Pat. No. 4,736,854 referred to above.

As can be seen in FIG. 1, retaining means (30) is generally L-shaped, one portion thereof fixedly attached to the distal end of the bar means, and the other portion (32) extending back above and parallel to (22) the bar means.

Figure 2:
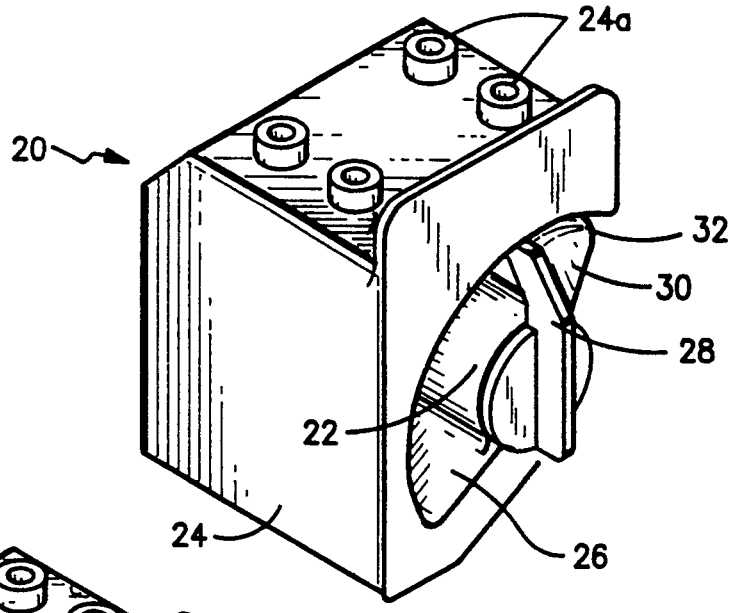
FIG. 2 shows the hanger suspending device in a first position.

Referring to FIG. 2, the position corresponding to the configuration shown in solid lines in FIG. 1 is shown in greater detail. The hanger bar means (22) includes a generally round, cylindrically convex surface, at least along a majority of its outer periphery. It is joined to the body portion (22) by cantilever support (26). Thus, hangers should be arranged with their hooked portions facing only in one direction since the shank portion of the hangers (that is that portion which connects the hook portion to the garment engaging portion) must hang vertically down on the side of the hanger bar means opposite from the cantilever portion (26) as illustrated in FIG. 1.

Figure 4:
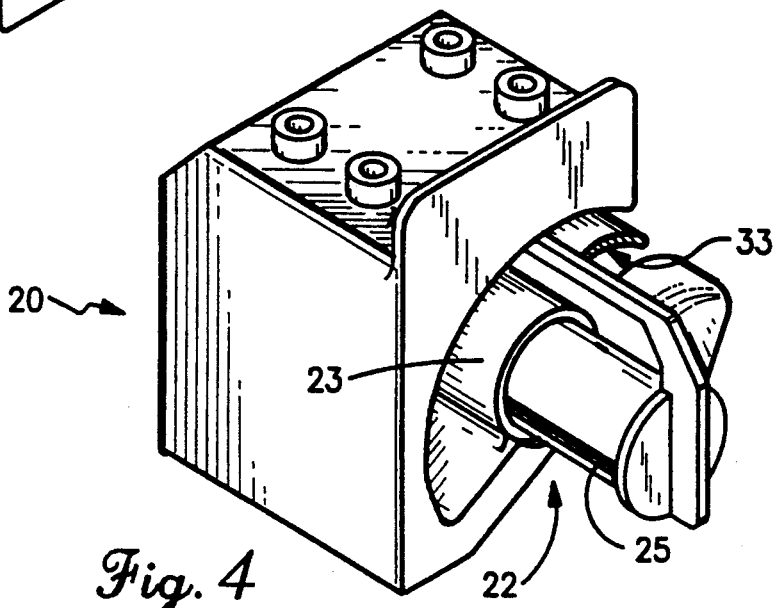
FIG. 4 shows the hanger device with the hanger bar in the lengthened position.

The hanger bar (22) includes a handle (28) which can be gripped easily by the user to rotate the outer portion of the hanger bar means to operate the same as will be outlined below. The retaining means (30) comprises an extension of the handle (28). The other portion (32) of the retaining means includes a convex portion (33) as shown in FIG. 4. It is this surface (and the extension of the handle 28) that generally retains the hooked portions of the hangers and prevents them from dislodging during the rigors of travel.

At the top surface of the body portion (24) are bosses (**24*a***) which receive self tapping screws (not shown) passing through the upper rail of the garment bag. In this way, the entire device is firmly held in the upper portion of the garment bag.

Figure 3:
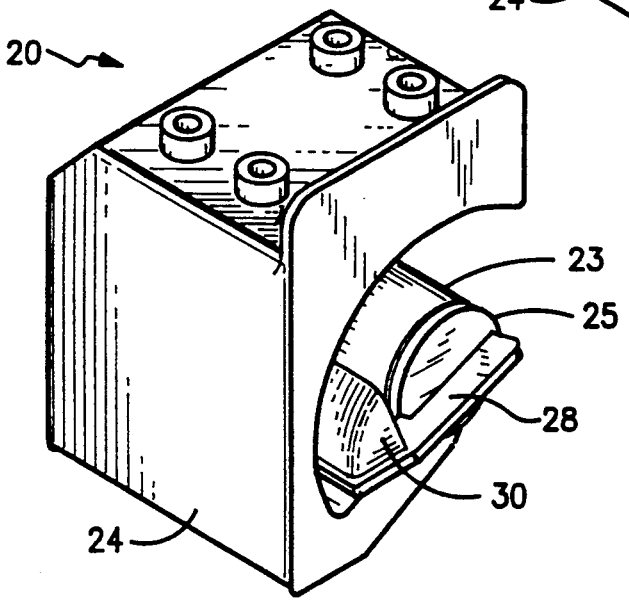
FIG. 3 shows the hanger device operated in the interim position.

FIG. 3 shows the device in a second operative condition. In particular, a first telescoping section (23) retains a second telescoping section (25) for selective movement in an axial direction as well as a relative rotational motion as will be detailed. In the position shown, hangers can be easily placed on the cylindrical surface of first section (23) by moving the hooked portions thereof axially over the front end of the rod means and placing them on section (23). Once this is done, the handle (28) can be operated to rotate the second section (25) clockwise to bring the hanger retaining means (30) to block the front of the opening as well as bring the concave surface (33) of the retainer portion (32) above the hanger to prevent the hanger from being displaced upwardly off of the section (23). As will be detailed, this vertical position as shown in FIG. 2 is held by a locking system and will stay in this position unless by the handle (28). To release the hangers, the operator need only rotate handle (28) counter-clockwise to expose the front opening of the device and simultaneously remove the retainer means from the concave surface from above the hanger hooks.

The telescoping section (25) together with the hanger retainer (30) attached thereto may be moved from its position shown in FIG. 3 to a position in FIG. 4, in the following manner. From the position shown in FIG. 3, spring means (42 in FIG. 5) is released to move the second telescoping section axially outward. Once in the fully lengthened condition, handle (28) is again rotated clockwise to bring the hanger retaining means (30) in its operative condition after additional portions of hangers are placed over the lengthened bar means (22). Once in position, shown in FIG. 4, the bar means (22) is locked in its telescoping position and the retainer surface (33) on its retaining means (30) is held in hanger retaining position shown with the hooked portions trapped on the lengthened rod means (22) by surface (33) and the downwardly facing curved surface (21) of member (24), and the vertical leg extension of handle (28).

Figure 5:
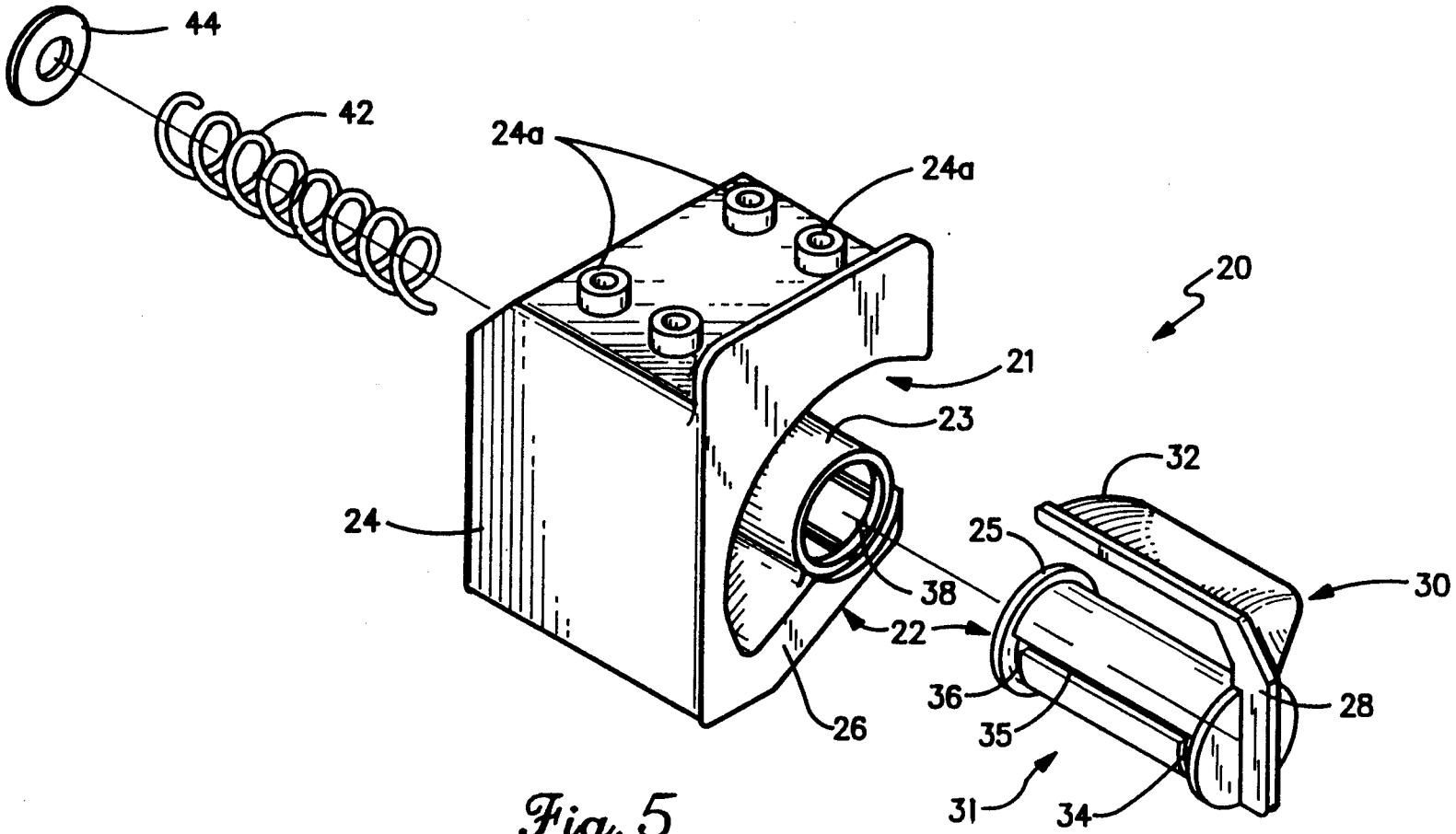
FIG. 5 is an exploded view of the suspending device in accordance with the instant invention.

Referring to FIG. 5, the mechanism for controlling the operation of the telescoping sections is shown. On the outer surface of the second telescoping section (25) there is provided a slot (33) which includes a first cam section (34) which extends substantially perpendicular to the axis of the rod means and partially circumferentially around and approximate to the distal end of second telescoping section (25). A second cam section (35) extends substantially parallel to the axis of the bar means and thus along an axial surface of the second telescoping section (25). A third cam section (36) is at the other end of second cam section (35). It also is perpendicular to the axis of the bar means.

Projecting inwardly towards these cam surfaces is cam follower in the form of a pin (38). This is an ordinary steel pin pressed through a radial hole extending from the outer surface of the device (24) through the inner surface of first telescoping section (23).

The inner telescopic section, second telescoping section (25), is mounted inside the first telescoping section (23) and positioned as shown in FIG. 3. Then the cam follower pin (38) is inserted through the radial bore to bring the inner end thereof into engagement in the slot (35). Specifically, in the region of the first cam section (34). This cam follower pin not only controls the axial and turning motion of second telescoping section (25) it also locks the section (25) in the positions shown in FIGS. 2 and 4, as well as retains that section and keeps it from falling out. The bias spring (42) extends up an axial bore (not shown) in second telescoping section (25) and is retained in a compressed state by retaining washer (44) which engages bosses (not shown) at the rear side of the device (24).

Thus, when the devices shown and the conditions shown in FIG. 2, the pin (38) is in the first cam section (34). Spring bias (42) holds the pin against the side of the cam section surface frictionally holding the hanger retainer (30) in the upright position. When the handle (28) is rotated counter-clockwise, this brings the pin (38) in alignment with second cam section (35). Spring bias (42) assists moving the pin (38) along the second cam section (35) to the third cam section (36). In this second open position, the second telescope section is fully lengthened or deployed by the spring (42). The handle (28) can now be rotated clockwise to bring the hanger retainer (30) in its hanger retaining position. Again frictional forces lock the telescoping section (25) in the position shown in FIG. 4. To enhance this locking operation, the cam sections (34 and 36) can have slots or detents which capture pin (38) and resist all but intentional manual rotation of section (25).

Thus, it can be seen the relatively simple, four piece construction disclosed provides the benefits of a hanger retaining system, regardless of whether the rod supporting the hangers is in a collapsed length (FIG. 2) or in an elongated length as shown in FIG. 4.

Once the invention is understood from the above, alternatives are readily obvious. For example, the cam follower pin may be carried by the second telescoping section (25) and the cam be part of the inner surface of the first telescoping section (23). Alternatively, the cam surface could be provided on the inner surface of the main body (24) of the hanger retaining device with a cam follower carried by the outer surface of the hanger retainer (30).

I claim:

1. In a luggage case of the type used to hold garments on hangers, said luggage case including a device for suspending the hangers by engaging the hooked portions thereof, the improvement comprising a) said device for suspending including i) bar means over which the hooked portions of hangers may be positioned. said bar means defining a first length from which at least one of said garments on hangers may be hung, ii) means positioned above said bar means for retaining said hooked portions on said bar means.

iii) means for lengthening said bar means beyond said first length to a second length whereby a greater number of garments on hangers may be accommodated thereon, and iv) means, carried by said bar means for locking said bar means when it is in said first length and said second length.

2. A luggage case as set forth in claim 1 wherein a) the luggage case has a slide type fastener and track arrangement sized and positioned around the periphery thereof to permit the luggage case to be selectively expanded in volume to accommodate variable numbers of garments, whereby said slide fastener can be operated in conjunction with said means for lengthening so that a different numbers of garments on hangers can be suspended from the device within the luggage case.

3. A luggage case as set forth in claim 2 wherein said slide type fastener and track arrangement is sized and positioned to expand the depth of the bag from a first depth which corresponds to said first length of said bar means to a second depth which corresponds to said second length.

4. A luggage case as set forth in claim 1 wherein said means for lengthening includes means for moving said means for retaining said hooked portions from a first position to a second position.

5. A luggage case as set forth in claim 4 wherein said means for retaining comprises an L-shaped member attached to said bar means at an end thereof.

6. A luggage case as set forth in claim 1 wherein said means for locking comprises a cam and cam follower contacting said cam, said cam having a first cam section extending perpendicular to the axis of said bar means, a second cam section extending substantially parallel to said axis of said bar means, and a third cam section remote from said first cam section extending substantially perpendicular to said axis of said bar means, at least one of said cam and said cam follower carried by said bar means.

7. A device for suspending garments on hangers within a garment bag comprising a) means for fastening said device in an upper portion of said garment bag, b) bar means over which the hooked portions of hangers may be positioned, said bar means defining a first length from which at least one of said garments on hangers may be hung, c) means for lengthening said bar means beyond said first length to a second length whereby a greater number of garments on hangers may be accommodated thereon, d) means for locking said bar means in said first length or said second length, e) means for retaining said hooked portions on said bar means, said means for retaining positioned above said bar means, wherein said bar means comprises a first telescoping section fixed to said means for fastening, and a second telescoping section axially mounted to said first section for movement relative to said first telescoping section along the axis thereof, said second telescoping section carrying said means for retaining said hooked portion on said bar means.

8. A device as set forth in claim 7 wherein said means for retaining comprises an L-shaped member fastened to said second telescoping section at an end thereof.

9. A device as set forth in claim 7 wherein said means for retaining includes a first portion and a second portion extending at an angle to said first portion, said first portion fixed to the distal end of said second telescoping section and said second portion extending above said bar means in space relationship such that the uppermost portions of the hooked portions of the hangers may be positioned between said bar means and said second portion of said means for retaining.

10. A device as set forth in claim 7 wherein said means for locking comprises a cam and cam follower contacting said cam, said cam having a first cam section extending perpendicular to the axis of said bar means, a second cam section extending substantially parallel to said axis of said bar means, and a third cam section remote from said first cam section extending substantially perpendicular to said axis of said bar means, at least one of said cam and said cam follower carried by said bar means.

11. A device as set forth in claim 10 wherein said bar means comprises a first telescoping section fixed to said means for fastening, and a second telescoping section axially mounted to said first section for movement relative to said first telescoping section along the axis thereof, wherein said one of said cam and said cam follower is carried by said first telescoping section.

12. A device as set forth in claim 11 wherein said second telescoping section is received within said first telescoping section, and said cam is positioned on the outer surface of said second telescoping section and said cam follower is carried on the inner surface of said first telescoping section to engage said cam.

13. A device as set forth in claim 12 wherein said cam is a slot and said cam follower is a pin.

14. A device as set forth in claim 7 wherein said means for retaining comprises a first leg attached to the distal end of said bar means and a second leg carried by said first leg and extending back over said bar means, said means for retaining moving with said distal end when said means for lengthening is operated.

* * * * *